United States Patent [19]

Soloviff et al.

[11] 4,438,962

[45] Mar. 27, 1984

[54] ALTERNATE MANUALLY AND ELECTRICALLY ACTUATED BOLT

[75] Inventors: Paul G. Soloviff, Tustin, Calif.; William C. Lichtenfels, West Hartford, Conn.

[73] Assignee: Emhart Industries, Inc., Farmington, Conn.

[21] Appl. No.: 308,150

[22] Filed: Oct. 2, 1981

[51] Int. Cl.[3] ..... E05B 47/00; E05C 1/06

[52] U.S. Cl. ..... 292/144

[58] Field of Search ..... 292/144, 142, 172, 201, 292/DIG. 65; 70/279

[56] References Cited

U.S. PATENT DOCUMENTS

| | | | |
|---|---|---|---|
| 1,169,659 | 1/1916 | Lowell . | |
| 3,234,766 | 2/1966 | O'Brien | 292/144 X |
| 3,541,874 | 11/1970 | Du Rocher | 74/424.8 |
| 3,947,060 | 3/1976 | Zimmer et al. | 292/142 |
| 4,012,929 | 3/1977 | Solovieff | 70/134 |
| 4,093,289 | 6/1978 | Inabayashi et al. | 292/336.3 |
| 4,126,341 | 11/1978 | Bradstock | 292/201 |
| 4,132,439 | 1/1979 | Millar | 292/144 |

*Primary Examiner*—Richard E. Moore

*Attorney, Agent, or Firm*—Mahoney & Schick

[57] ABSTRACT

A bolt of the type mounted in a door is longitudinally movable between extended and retracted positions by a reversible electric motor connected to the bolt through gear means and a part of manual operator means for the bolt. The gear means from the motor includes extensive gear reduction and terminates in a driving gear comprised of circumferentially spaced gear segments engageable with a driven gear telescoped with the manual operator means, the driving gear segments being positioned completely disengaging the driven gear at either of the bolt extended or retracted positions and either gear segment engaging the driven gear for moving the bolt between its extended and retracted positions. Thus, the bolt may be moved between its extended and retracted positions either by the manual operator means without consequent movement of the major portion of the gear means and electric motor, or by the electric motor and gear means. The manual operator means extends transversely into engagement with bolt moving means for moving the bolt and is comprised of a key operated lock at one side and a thumbturn at the other side. The driven gear is normally connected for rotating the manual operator means to move the bolt therethrough, but by selected axial movement of the manual operator means, the driven gear may be disconnected therefrom. Thus, upon failure of the motor during bolt movement thereby intermediate extended and retracted positions, selected axial movement of the manual operator means eliminates the motor and gear means through disconnection so that the bolt may be readily moved by the manual operator means.

36 Claims, 12 Drawing Figures

ALTERNATE MANUALLY AND ELECTRICALLY ACTUATED BOLT

BACKGROUND OF THE INVENTION

This invention relates to an alternate manually and electrically actuated bolt, and more specifically, to such a bolt assembly having unique mechanisms therein for accomplishing the two distinct manual and electrically driven functions thereof in an improved and separable manner while eliminating the disadvantages of the prior constructions. According to one concept which may be incorporated as one embodiment of the present invention, the bolt may be driven to and between its extended and retracted positions alternately by either the manual or electrical drive, but more important, when moved into either extended or retracted position by the electrical drive, a preferably major portion of the electrical drive automatically effectively disconnects from the bolt so that as an end result, when the bolt is in either of its extended or retracted positions, there is automatically presented a free choice of either manual or electrical actuation as to next moving the bolt and the bolt movement may be freely accomplished by the chosen means without disconnecting or otherwise involving the other. According to another concept which may be incorporated as another embodiment of the present invention, the bolt may again be alternately driven between its extended and retracted positions by either the manual or electrical drive, but if the electrical drive should fail during use of the electrical drive wherein the bolt is positioned intermediate its extended and retracted positions, for instance, due to electric power interruption, the overall assembly is arranged such that by a simple manipulation, a major portion of the electrical drive mechanism including at least a major part of the gear means may be effectively disconnected from the bolt so as to permit the usual manual drive to complete the bolt movement to either of its extended or retracted positions. Of course, the optimum is the incorporation of both concepts in the same embodiment of the present invention so that a free choice of either manual or electrical actuation is presented when the bolt is in either of its extended or retracted positions, yet when the bolt is under electrical actuation intermediate its extended and retracted positions with electrical failure occurring, the bolt may be quickly moved into either of its positions by the manual actuation.

Various bolt assemblies have heretofor been provided wherein the bolts thereof are electrically actuated in one manner or another. Commonly, two basic classes of bolts are involved, the far less secure spring-bolts which are spring urged to extended position and retracted against the spring urging by simple electrically actuated solenoids, and deadbolts which must be positively actuated in both directions between extended and retracted positions through gear connected electric motors. It is this latter class of bolt assemblies with which the present invention is involved and which provides far greater security than the spring-bolt assemblies.

In the provision of deadbolt assemblies wherein the bolt is movable between extended and retracted positions by a reversible electric motor, to appreciate the problems involved, it must be remembered that total bolt movement in either direction is only approximately one inch, sometimes slightly more and sometimes slightly less depending upon the particular assembly. Thus, in connecting a reversible electric motor theretofor producing such relatively slight movement, the basic rotatable movement of the electric motor must be quite extensively reduced through various gear reduction means for ultimate operable connection to the bolt. The prime consideration is that with this extensive gear reduction between the electric motor and the bolt for transferring the necessary motion, it is virtually impossible to otherwise move the bolt, say by some form of manual actuation thereof, for so long as the motor connecting gear means remains effectively connected with the bolt.

However, it is well known that there is always presented the possibility of electrical power failure which could temporarily disable the electric motor drive during which it would be impossible to move the bolt unless the capability of bolt manual actuation is incorporated in the assembly. Furthermore, there are many instances where deadbolt assemblies solely driven by electric motors are not desirable, but rather alternate manually and electrically actuated assemblies are required. This presents the problem of just how to provide a deadbolt assembly which may be alternately manually and electrically actuated without the mechanism for accomplishing the one form of actuation prohibitively affecting the mechanism for accomplishing the other form of actuation.

Certain of the prior constructions have incorporated alternate manual and electrical actuation of deadbolts. The electric motors are connected to the deadbolts through the severe gear reduction arrangement for electrical actuation and the means for manually actuating the deadbolts have usually been arranged and connected in a manner similar to that of totally manually actuated deadbolts where electrical actuation is not involved. In order to accommodate manual actuation of the deadbolts during failure of the electrical system, slip clutch means, usually in the form of common friction clutches, are provided within the gear connection of the electric motors at some location near the connections to the deadbolts. Thus, if the electrical system fails, manual actuation of the deadbolts can be accomplished by overcoming the friction drive of the particular clutch through such manual actuation with the clutch thereby eliminating the remainder of the gear connection and eliminating the requirement for movement of the same.

Although this slip or friction clutch bypassing of the main part of the electrical drive and particularly the majority of the gear connection thereof may be satisfactory where electrical actuation is the prime goal of the deadbolt assembly involved and manual actuation is only intended for the temporary electrical energy failure on an emergency basis, it is clearly not satisfactory where the deadbolt assembly is intended for frequent alternate use between manual actuation and electrical actuation. Manual actuation of the deadbolt while being required to cause slippage of the friction clutch in the electrical system can be relatively difficult, and particularly where the friction clutch is of sufficient power transmitting strength to properly function in the electrical system for actuating the deadbolt electrically over a long period of time. For these reasons, improvements are demanded in the deadbolt connections where true alternate manual and electrical actuation thereof is desired.

OBJECTS AND SUMMARY OF THE INVENTION

It is, therefore, a general object of the present invention to provide an alternate manually and electrically actuated bolt which, under normal operating conditions, is satisfactorily operable on a true alternate basis without the electrical actuation means being objectionably interfered with by the manual actuation means and with the manual actuation means not being objectionably interfered with by the electrical actuation means. If the bolt is intended to be operated in the electrical mode, it is electrically actuated in the usual simple manner and only a small portion of the manual actuating means, if any, is involved. On the other hand, if the bolt is to be operated in the manual mode, it may be manually actuated in a generally conventional manner with a major portion, if not all, of the electrical actuating means remaining dormant.

It is a further object of this invention, according to one embodiment thereof, to provide an alternate manually and electrically actuated bolt wherein, starting from bolt retracted position or bolt extended position, the electrical actuating means, and particularly the major portion of the gear means thereof, is initially completely disconnected from the bolt so that there is a free choice of either electrical actuation or manual actuation, again, one not objectionably interfering with the other. According to this novel concept comprising one embodiment of the present invention, the bolt is connected to the electric motor by use of at least one gear segment in the connecting gear means thereof during such electrical actuation. The gear segment is positioned such that it completely disengages in the gear means at the bolt extended or retracted position. Thus, from either of the bolt extended or retracted positions, at least the major portion of the gear means for the electrical actuation is always disconnected by this gear segment permitting usual manual actuation, but at the same time, if electrical actuation is desired, it is carried out in the usual manner with the gear segment ultimately engaging and providing the bolt moving motion in either direction of bolt movement.

It is still a further object of this invention, according to another embodiment thereof, to provide an alternate manually and electrically actuated bolt wherein, if during any period of bolt movement by the electrical actuating means there is electrical power failure resulting in a temporary failure of the electrical actuating means, a simple manual manipulation of certain of the parts thereof causes a temporary disconnection of at least a major portion of the electrical actuating means so that thereafter, during this temporary disengagement, the bolt may be moved by the manual actuating means in the usual manner. According to a preferred embodiment involving this concept of the present invention, the gear means of the electrical actuating means is operably connected to the bolt preferably through a portion of the manual actuating means and the manual actuating means is arranged for temporarily disconnecting the electrical actuating means from the bolt through a relatively slight temporary manipulation of the manual actuating means. During this temporary manual actuating means manipulation, the bolt may be moved by usual operation of the manual actuating means. Thus, manual actuation of the bolt is permitted during this temporary power failure condition despite the fact that the electrical actuating means have been previously connected to the bolt and without such selective disconnection would have prevented such bolt manual actuation.

It is also an object of the present invention to provide an alternate manually and electrically actuated bolt of the foregoing general character and including one or both of the novel concepts according to the present invention, yet which may be provided in a relatively simple overall assembly for a minimum of manufacturing material and labor cost. In a preferred embodiment form and including both of the novel concepts of the present invention, one portion of the improvement is provided by the gear segment or segments installed in the gear means connection of the electric motor to the bolt and this requires only a relatively inexpensive special gear fabrication. The other portion of the improvements are created by connecting the gear means of the electrical actuating means through the manual actuating means and providing a simple temporarily manually effected disconnection of the gear means from the manual actuating means, all in a relatively simple manner. Thus, all or part of the improvements of the present invention may be provided relatively economically.

Other objects and advantages of the invention will be apparent from the following specification and the accompanying drawings which are for the purpose of illustration only.

DESCRIPTION OF THE BEST EMBODIMENT CONTEMPLATED

Figure 1:
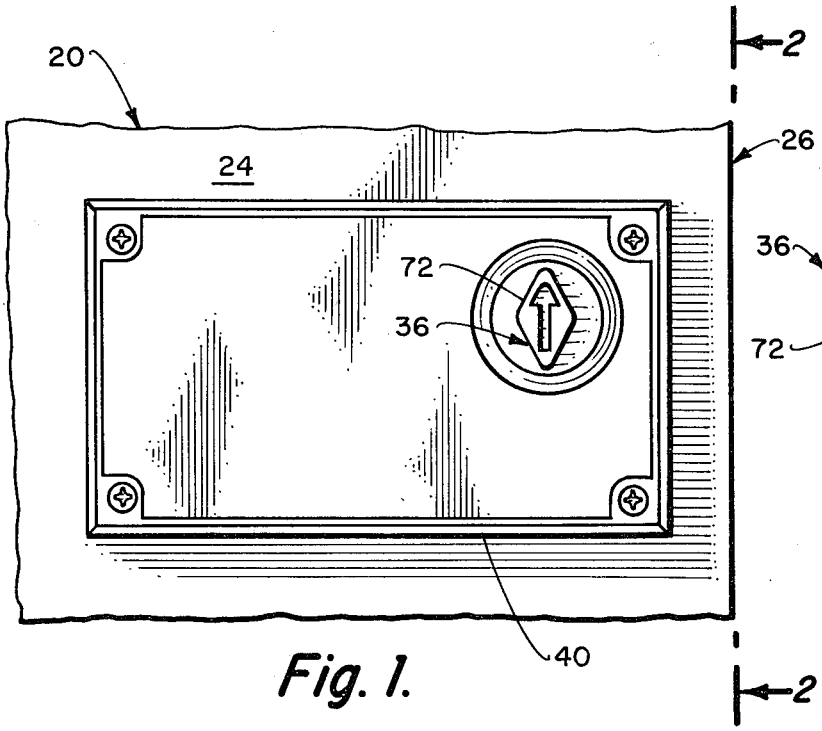
FIG. 1 is a side elevational view of a preferred embodiment of the alternate manually and electrically actuated bolt according to the present invention installed in a usual door, shown in fragmentary view, looking at the inferior side of the door and with the bolt in fully retracted position.

Referring to the drawings, a preferred embodiment of the alternate manually and electrically actuated bolt of the present invention is shown mounted in a typical environment, a usual door generally indicated at 20. The door 20 may be of usual form having an exterior side generally indicated at 22, an interior side generally indicated at 24 and a door edge generally indicated at 26. Furthermore, the door 20 may be typically hinge mounted in a door frame generally indicated at 28 (FIG. 7), the door frame having the usual properly aligned bolt keeper generally indicated at 30 recess mounted therein, all of which will be hereinafter discussed more in detail.

More specifically to the alternate manually and electrically actuated bolt assembly, the assembly is mounted on and in the door 20, and includes a somewhat standard bolt and bolt moving means generally indicated at 32, a first manual operator preferably in the form of a pin-type, key actuated lock generally indicated at 34, a second manual operator preferably in the form of a thumbturn generally indicated at 36 and electrical actuation means generally indicated at 38. As generally shown, the bolt and bolt moving means 32 is mounted in somewhat usual manner within the door 20 extending generally longitudinally in alignment with the bolt keeper 30 of the door frame 28 and the lock 34 is mounted at the door exterior side 22 transversely connected to the bolt and bolt moving means 32. The thumbturn 36 is mounted at the door interior side 24 also transversely connected to the bolt and bolt moving means 32, the thumbturn being mounted within a rectangularly shaped case 40 secured to the door interior side and also housing substantially the entire of the electrical actuation means 38.

Figure 2:
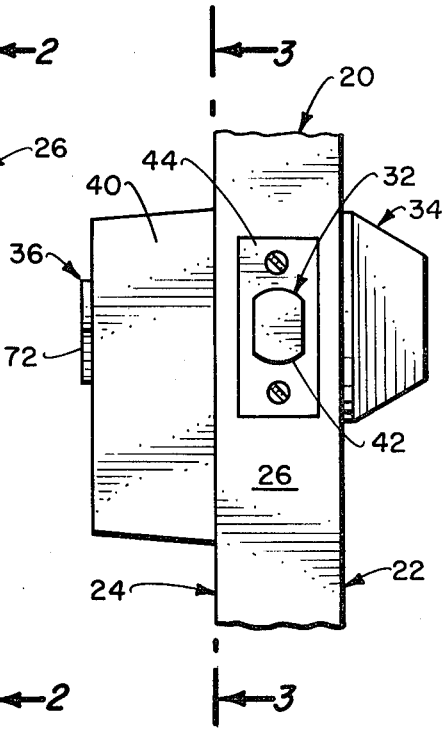
FIG. 2 is a fragmentary, door edge elevational view looking in the direction of the arrows 2—2 in FIG. 1.

As stated, the bolt and bolt moving means 32 within the door 20 is of somewhat usual construction and is fully disclosed in U.S. Pat. No. 4,012,929 issued Mar. 22, 1977 and entitled LATCH CONSTRUCTION WITH IMPROVED ANTI-VIOLATION FEATURES. Briefly, the bolt and bolt moving means 32 includes a deadbolt 42 longitudinally movable in a bolt housing 44 between a fully retracted position fully within the door edge 26 as shown, for instance, in FIGS. 2 and 5, and a fully extended position, shown in broken lines in FIG. 7, projecting a maximum distance into the bolt keeper 30 of the door frame 28. The deadbolt 42 is moved longitudinally by a pair of driving levers 46 pivotly connected at their forward ends to the deadbolt and rearwardly pivotly connected to a crank arm 48 partially rotatable by a crank hub 50, all operably mounted within a latch frame 52.

The pivotal connection between the rearward ends of the driving levers 46 and the crank arm 48 is formed by a transverse drive pin 54 which is of increased length to project axially over the latch frame 52. A transversely aligned pair of guide slots 56 is formed in the latch frame at least just longitudinally rearwardly of the bolt housing 44 for receiving the ends of the described drive pin 54 when the deadbolt 42 is in its fully extended position as shown in broken lines in FIG. 7. This resists rearward driving of the bolt by an outside force attempting to move the bolt longitudinally rearwardly from its fully extended position other than by the crank arm 48 and crank hub 50, all as disclosed in the prior patent referred to above.

The lock 34 at the door exterior side 22 is, for the main part, also of somewhat usual construction including a lock frame 58 transversely abutting and projecting into the door exterior side 22 mounting a lock cylinder 60 which, in turn, mounts a lock plug 62 rotatable about a transverse axis. As stated, the lock 34 is of the usual pin-type and the lock plug 62 thereof is manipulated in the usual manner by an appropriate key 64. The lock plug 62 is axially connected through a usual lost motion connection 66 to a transversely extending torque blade 68 which extends through the crank hub 50 of the bolt and bolt moving means 32 non-rotatable relative thereto, but, importantly, selectively transversely slideably movable relative thereto.

Figure 4:
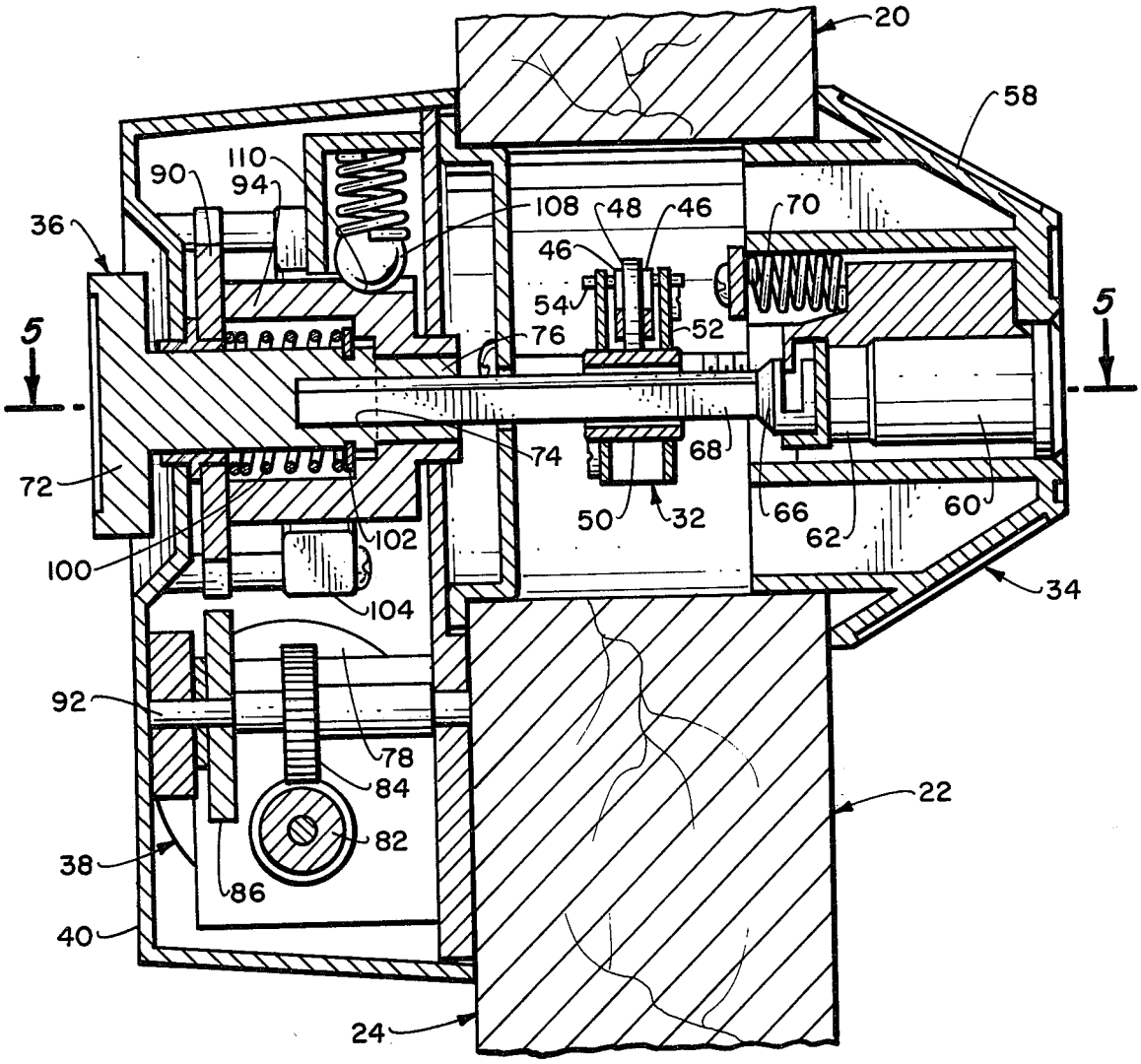
FIG. 4 is an enlarged, fragmentary, vertical sectional view looking in the direction of the arrows 4—4 in FIG. 3.
Figure 9:
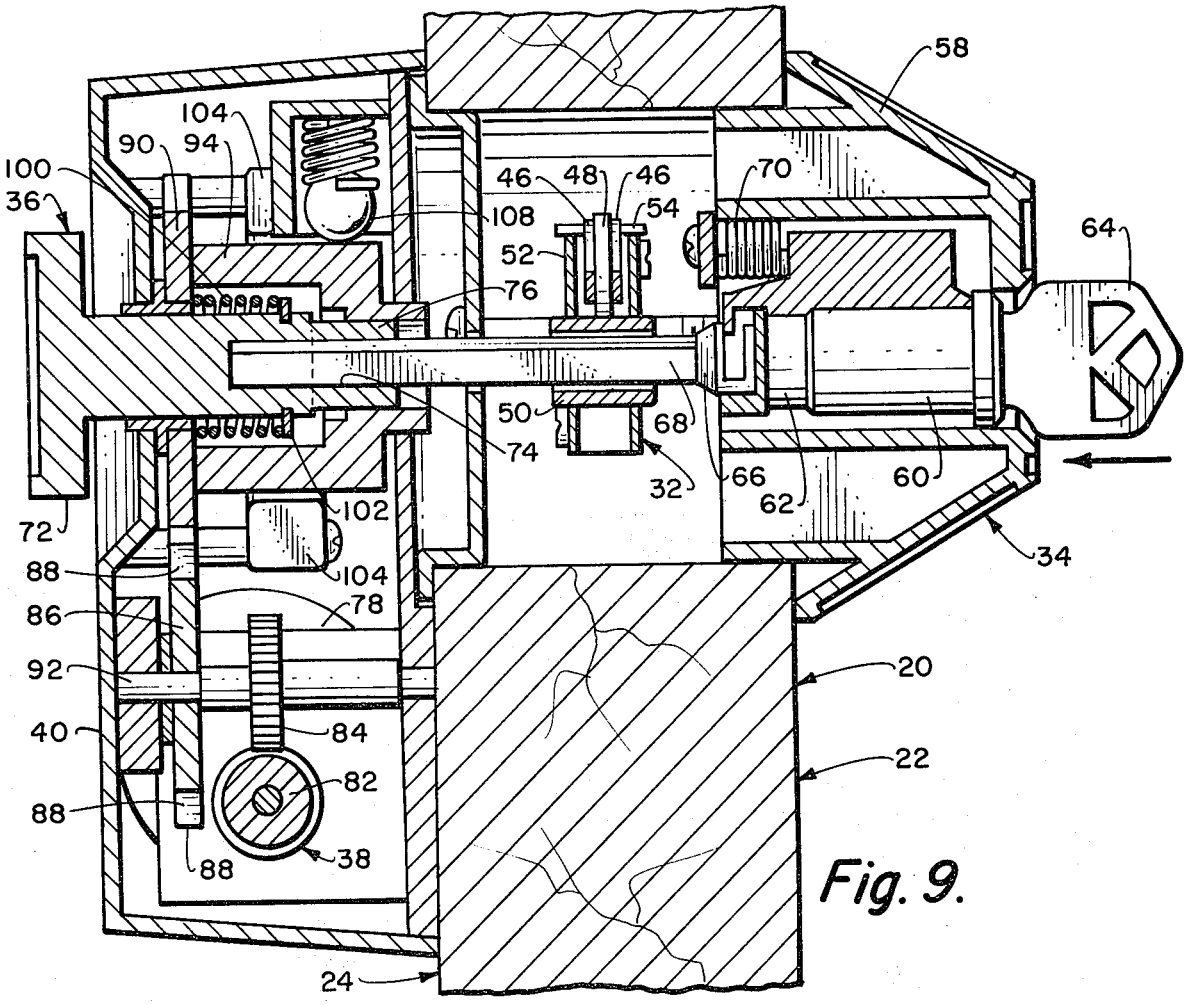
FIG. 9 is a view similar to FIG. 4, but showing the bolt ready to be manually actuated and moved from the position of FIG. 7 by the exterior door side lock under emergency power failure conditions.

Equally importantly to the principals of the present invention, the lock cylinder 60 and its telescoped lock plug 62 are transversely or axially selectively movable relative to the lock frame 58, such movement being from normal position shown, for instance, in FIG. 4 transversely inwardly a selected distance against the resilient urging of resilient means in the form of a spring 70 and to an inward position shown, for instance, in FIG. 9. In this transverse movement of the lock cylinder 60 and the lock plug 62, the torque blade 68 is carried transversely with the lock plug sliding transversely through the crank hub 50. Thus, in any transverse position of the lock cylinder 60 and lock plug 62, the lock 34 is conventionally operable by the key 64 for moving the deadbolt 42 fully between its extended and retracted positions with the lost motion connection 66 permitting return of the lock plug 62 to a neutral position wherein the key 64 may be removed, all in known manner. The purpose of the selected manual transverse movement of the lock cylinder and lock plug 60 and 62 as it relates to the principal of the present invention will be discussed below.

At the door interior side 24, the thumbturn 36 is rotatably mounted by the case 40 having an outer end 72 accessible outwardly of the case and projecting transversely through the case. An axial or transverse recess 74 is formed at inner end 76 of the thumbturn 36 in transverse alignment with and transversely slideably receiving the torque blade 68 non-rotatable relative thereto. When the thumbturn 36 is in normal transverse position as shown, for instance, in FIGS. 4, 5 and 7, the torque blade 68 is telescoped by the thumbturn 36 substantially the entire transverse length of the recess 74. Furthermore, the thumbturn 36 is mounted selectively transversely movable relative to the case 40 and the torque blade 68 for important purposes of the present invention, all of which will be described below. However, to the extent thus far described, it is apparent that in any transverse position of the thumbturn 36, the same may be selectively manually rotated for moving the deadbolt 42 between its extended and retracted positions in usual manner and without rotation of the lock plug 62 of the lock 34 due to the lost motion connection 66 previously described.

The electrical actuation means 38 mounted substantially totally within the case 40 includes a usual reversible electric motor 78 operably connected for rotating gear means preferably in the form of a conventional gear reduction unit 80, a worm gear 82, a worm gear follower 84, a multiple gear segment 86 preferably having two, spaced and identical driving gear segments 88, and a driven gear 90. The electric motor 78, gear reduction unit 80, worm gear 82 and worm gear follower 84 are conventionally permamently engaged so that rotation of the electric motor in either direction rotates these elements in the appropriate direction. Furthermore, the worm gear follower 84 and the multiple gear segment 86 are secured on a same rotatable mounting shaft 92 as shown, for instance, in FIG. 4, so that rotation of the worm gear follower rotates the multiple gear segment. However, as between the multiple gear segment 86 and the driven gear 90, when the multiple gear segment is in a rotatable position with both of the driving gear segments 88 rotatably spaced from the teeth of the driven gear, rotation of the multiple gear segment will not rotate the driven gear until one of the driving gear segments comes into engagement with the teeth thereof, this relationship serving an important purpose according to certain of the principals of the present invention as will be hereinafter discussed.

Figure 12:
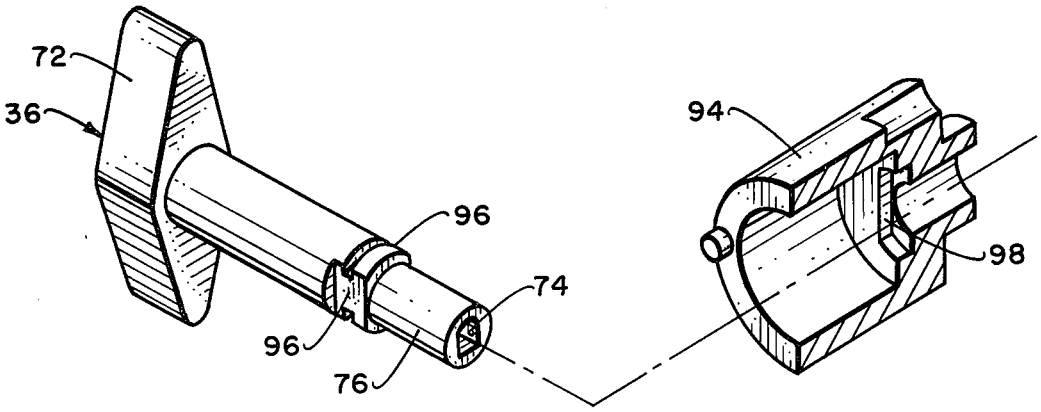
FIG. 12 is an exploded, partial sectional perspective view of a part of the interior door side manual operator.
Figure 5:
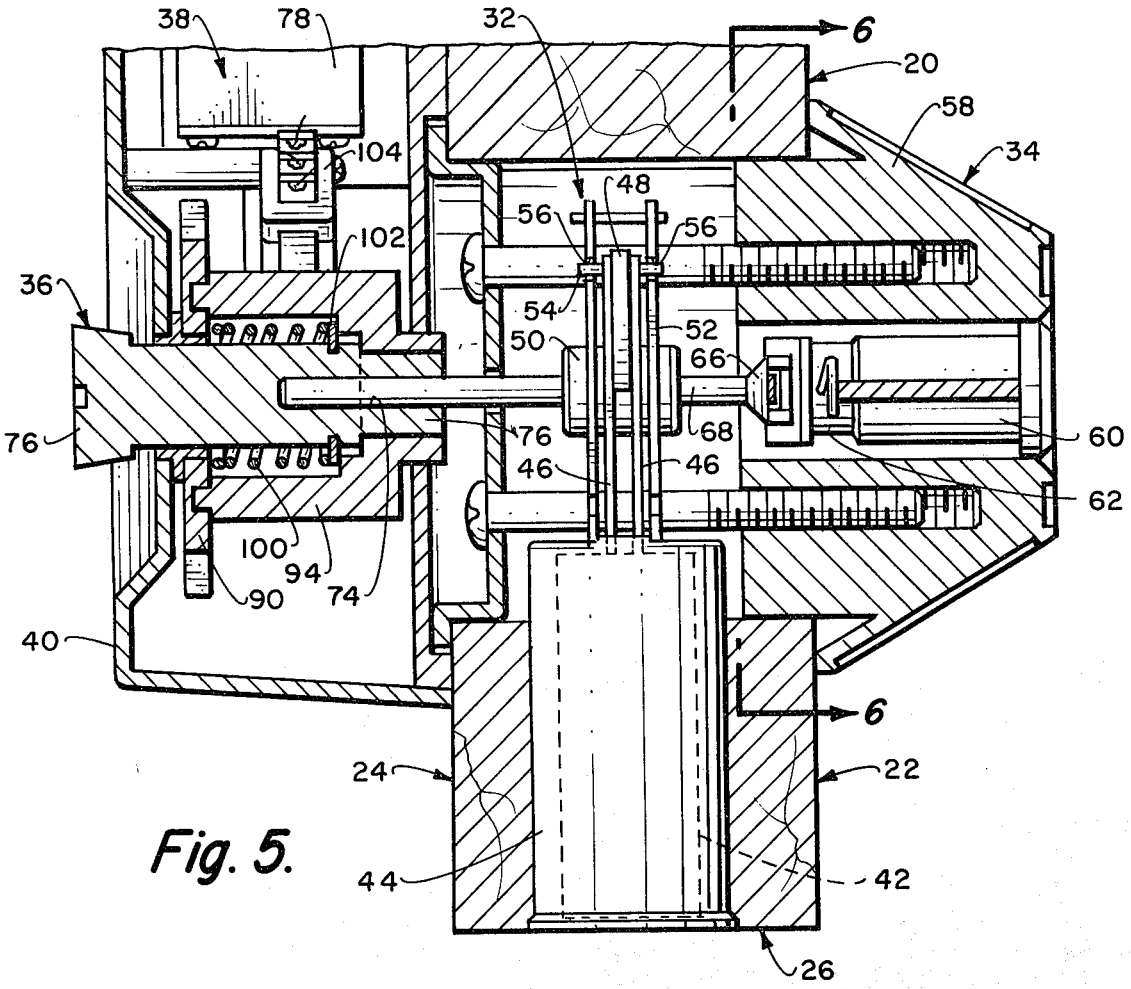
FIG. 5 is a fragmentary, horizontal sectional view looking in the direction of the arrows 5—5 in FIG. 4.
Figure 6:
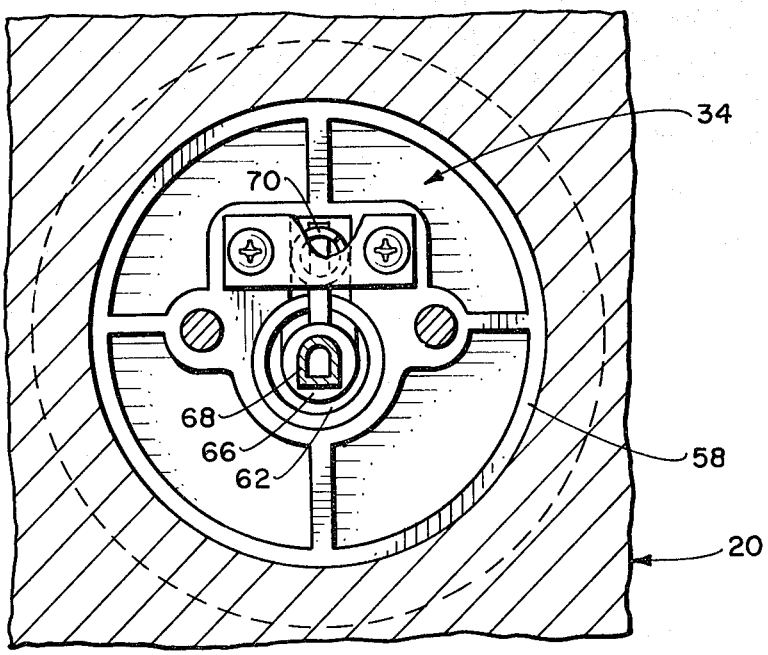
FIG. 6 is a fragmentary, vertical sectional view looking in the direction of the arrows 6—6 in FIG. 5.

The driven gear 90 is mounted telescoping and rotatable relevant to the thumbturn 36 so that the driven gear is freely rotatable relative to the thumbturn if nothing further is considered. The driven gear 90, however, is pin connected to a coupling 94 also telescoping the thumbturn 36 as shown, for instance, in FIG. 5, and the coupling is interengaged with the thumbturn for transmitting rotation thereto when the thumbturn is in its normal position shown in FIGS. 4 and 5, but the coupling is disengaged from the thumbturn for relative rotation therebetween when the thumbturn is moved axially or transversely outwardly relative to the coupling. The interengagement between the thumbturn 36 and the coupling 94 is best illustrated in FIG. 12 wherein opposite flats 96 on the thumbturn will mate and abut with opposite flats 98 on the coupling when the thumbturn is in normal transverse position relative to the coupling. As shown in FIGS. 4 and 5, a coil spring 100 telescopes the thumbturn 36 within the coupling 94 bearing resiliently outwardly against the driven gear 90 and inwardly against a retainer 102 engaged with the thumbturn so that the thumbturn is resiliently urged to normal position and engaged with the coupling, but is selectively transversely movable for the disengagement therefrom.

Figure 11:
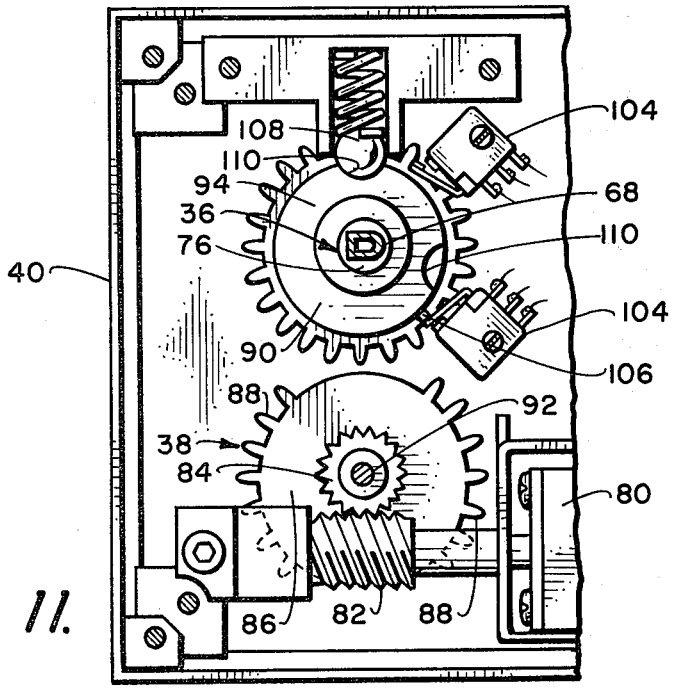
FIG. 11 is a view similar to FIG. 8, but with the elements shown as positioned when the bolt is in fully extended position.

The rotation of the gear means and particularly the multiple gear segment 86 by the electric motor 78 is specifically coordinated with the longitudinal movement of the deadbolt 42 so that when the deadbolt is in either of its fully extended or fully retracted positions, the multiple gear segment 86 is specifically rotatably positioned so that each of the driving gear segments 88 thereof is circumferentially spaced from the teeth of the driven gear 90 and there is no engagement between either of the driving gear segments and the driven gear. This relationship is shown when the deadbolt 42 is in its fully retracted position in FIG. 3 and the same is true in deadbolt fully extended position as shown in FIG. 11. This coordination between the deadbolt 42 and the electric motor 78 comprising the multiple gear segment 86 with its driving gear segments 88 is established and maintained by spaced limit switches 104 which are mounted engageable by an appropriately positioned actuating lug 106 on the circumference of the coupling 94 as seen, for instance, in FIG. 3.

Thus, under electrical actuation and with the deadbolt 42 in either of its fully extended or retracted positions, starting of the electric motor 78 by, for instance, either a manually actuated electrical switch, (not shown) or a usual remote electrical control (not shown) will begin to rotate the multiple gear segment 86 in the appropriate direction and ultimately one of the driving gear segments 88 will come into engagement with the driven gear 90, in turn, rotating the normally positioned thumbturn 36 through the coupling 94 which rotates the crank hub 50 of the bolt and bolt moving means 32 through the torque blade 68 to move the deadbolt 42 longitudinally to its other position. As the deadbolt 42 moves into its other position, the driving gear segment 88 of the multiple gear segment 86 then engaged with the driven gear 90 will begin and complete its disengagement from the driven gear, but there normally will be sufficient overrun of movement of the various elements so that the motion of the multiple gear segment 86 by the electric motor 78 will be stopped with the driving gear segments 88 thereof equally circumferentially spaced from the teeth of the driven gear 90 as illustrated in either of FIGS. 3 and 11. In order to insure correct positioning, however, positive positioning means in the form of a spring pressed detent or ball 108 is received in appropriately circumferentially spaced and located positioning recesses 110, the spring pressed ball beginning to engage and move into the particular positioning recess as the the particular driving gear segment 88 completes its disengagement from the driven gear 90 with the ball continuing to urge rotation until fully seated within the particular positioning recess.

In the various overall operations of the alternate manually and electrically actuated bolt preferred embodiment as described, and initially assuming normal operating conditions, the deadbolt 42 may be manually moved between its extended and retracted positions by either of the exterior lock 34 or the interior thumbturn 36, or electrically by appropriate electrical energizisation of the electric motor 78, and in no case will one interfere with actuation of the others. Referring for the moment to FIGS. 1 through 5, the deadbolt 42 is in its fully retracted position. In this deadbolt fully retracted position, the multiple gear segment 86 is positioned with the driving gear segments 88 thereof spaced at either side and free of engagement from the teeth of the driven gear 90 thereby disconnecting the remainder of the gear means to the electric motor 78 from the thumbturn 36 and, therefore, from the deadbolt 42. Thus, the overall assembly is ready for either movement of the deadbolt 42 from its retracted to its extended position by the manual actuation means, either of the lock 34 and thumbturn 36 manually, or the electrical actuation means 38 through the electric motor 78.

If it is desired to manually actuate the deadbolt 42 and move it from the fully retracted position to its fully extended position by the lock 34 at the door exterior side 22 under these normal conditions, the key 64 is inserted in the lock and the lock plug 62 rotated thereby in the appropriate direction which first overcomes the lost motion connection 66 in the usual manner and ultimately begins to rotate the torque blade 68. Rotation of the torque blade 68 also rotates the thumbturn 36 due to its non-rotatable connection thereto, as well as the driven gear 90 and the coupling 94 through the abutting flats 96 and 98, but the remainder of the gear means to the electric motor 78 remains stationary due to the disconnection between the multiple gear segment 86 and the driven gear 90. Thus, the deadbolt 42 will be permitted to be moved without interference from the major part of the gear means to the electric motor 78.

Figure 7:
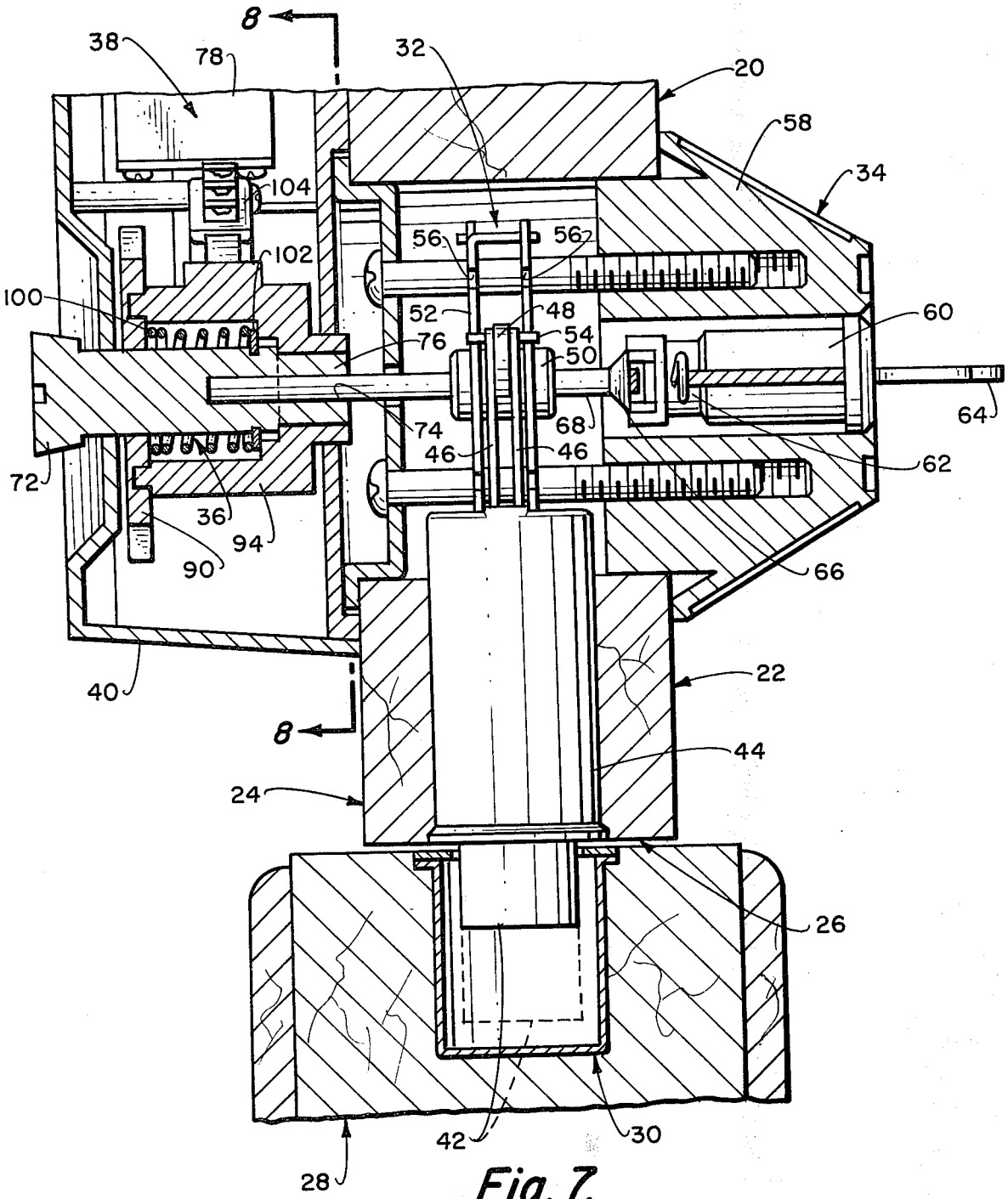
FIG. 7 is a view similar to FIG. 5, but showing the bolt moved from fully retracted position partially toward fully extended position engaged in a keeper of a door frame.

The deadbolt 42 moves longitudinally from retracted position of FIGS. 1 through 5 through the partial extended position of FIG. 7 and ultimately into fully extended position wherein the driven gear 90 arrives at the position shown in FIG. 11 and the multiple gear segment 86 remains in its disconnected position since it has not been moved. The key 64 may then be reversely rotated rotating the lock plug 62 back to the neutral position as permitted by the lost motion connection 66 in the usual manner and for removal of the key. Furthermore, the key 64 may be similarly used for moving the deadbolt 42 back to its retracted position in similar manner.

Again starting with the deadbolt 42 in its fully retracted position shown in FIGS. 1 through 5, if it is desired to move the deadbolt to fully extended position through use of the thumbturn 36 at the door interior side 24, it is similarly permitted without interference from the major portion of the gear means to the electric motor 78 under these normal conditions.

Figure 3:
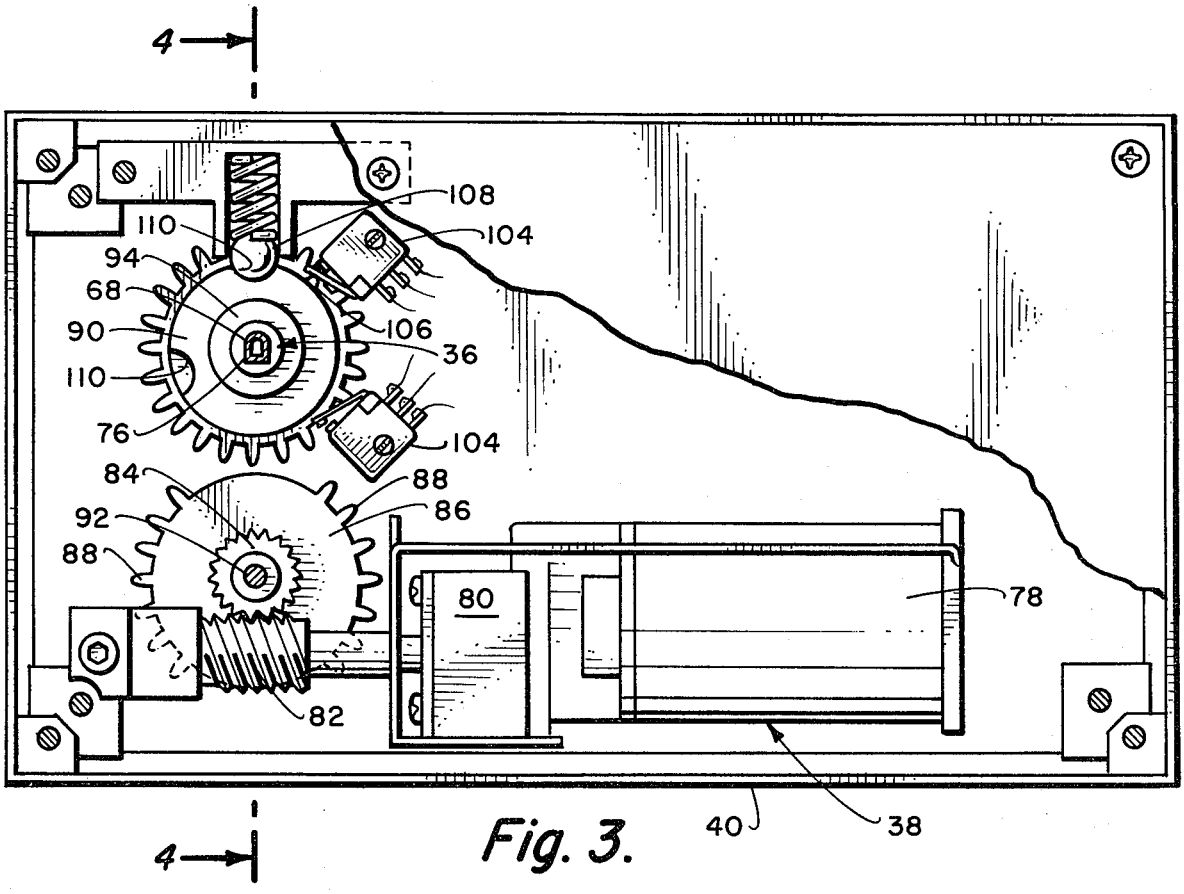
FIG. 3 is an enlarged, fragmentary, vertical sectional view, with parts broken away, looking in the direction of the arrows 3—3 in FIG. 2.

The thumbturn 36 is merely rotated in the appropriate direction and through the torque blade 68 will again move the deadbolt 42 through the partially extended position shown in FIG. 7 to the fully extended position, the lock plug 62 of the lock 34 not being required to move due to the lost motion connection 66. During rotation of the thumbturn 36, the driven gear 90 and the coupling 94 will again rotate therewith, but the remainder of the gear means to the electric motor 78 will remain disconnected due to the positioning of the multiple gear segment 86 as previously described and as shown in FIG. 3 in deadbolt fully retracted position and in FIG. 11 in deadbolt fully extended position. The deadbolt 42 may be moved from its fully extended position to its fully retracted position by manual actuation through the thumbturn 36 merely by a reverse rotation of the thumbturn.

Still at the same time, under the normal operating conditions, if it is desired to move the deadbolt 42 from its fully retracted position shown in FIGS. 1 through 5 to its fully extended position by the electrical actuation means 38, the electric motor 78 is electrically energized for rotation in the appropriate direction beginning to rotate the multiple gear segment 86 through the gear reduction unit 80, the worm gear 82 and the worm gear follower 84. As one of the driving gear segments 88 of the multiple gear segment 86 comes into engagement with the teeth of the driven gear 90, the driven gear begins to rotate rotating the coupling 94, the thumbturn 36 through the abutting flats 96 and 98, the torque blade 68 and thereby longitudinally moving the deadbolt 42 ultimately to its fully extended position.

During this deadbolt 42 movement, although the thumbturn 36 will rotate due to the particular connection of the driven gear 90 to the deadbolt through the thumbturn, the lock plug 62 of the lock 34 will not rotate in view of the lost motion connection 66 between the lock plug and the torque blade 68. In the fully extended position of the deadbolt 42, the multiple gear segment 86 and the driven gear 90 will come to the relative positions as shown in FIG. 11 wherein both of the driving gear segments 88 are spaced from the teeth of the driven gear. Thus, with the deadbolt 42 moved into its fully extended position by the electrical actuation means 38 as described, anytime thereafter, the deadbolt may be moved back into its fully retracted position shown in FIGS. 1 through 5 by either of the electrical actuation means 38 merely by the reverse actuation thereof or by either of the manual actuation means, the lock 34 or the thumbturn 36, and one will not operably interfere with the other.

Figure 8:
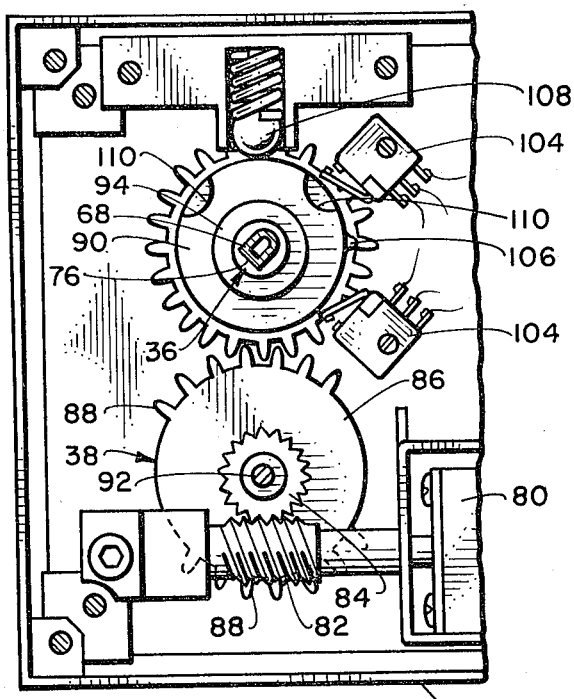
FIG. 8 is a fragmentary, vertical sectional view looking in the direction of the arrows 8—8 in FIG. 7.

The foregoing illustrates normal operating conditions for the alternate manually and electrically actuated bolt of the present invention, but now assume emergency loss of electrical power conditions. With the construction as described, the only time that loss of electrical power would be of consequence would be intermediate actuation of the deadbolt 42 between its fully extended and fully retracted positions by the electrical actuation means 38 and when one of the driving gear segments 88 of the multiple gear segment 86 is engaged with the teeth of the driven gear 90. Such a positioning is illustrated in FIGS. 7 and 8, the deadbolt 42 being shown in FIG. 7 approximately one half way between its fully extended and retracted positions consequently positioning one of the driving gear segments 88 of the multiple gear segment 86 in positive engagement with the teeth of the driven gear 90 as in FIG. 8. With the electrical actuation means 38 fully engaged at this intermediate positioning of the deadbolt 42, the deadbolt cannot be moved to either of its fully extended or fully retracted positions by either of the lock 34 or the thumbturn 36 due to the gear means to the electric motor 78, now stopped, preventing such movement.

Under these emergency circumstances, the deadbolt 42 may be manually actuated to complete its movement to either of its fully extended or fully retracted positions by either of the lock 34 or the thumbturn 36 through selected manipulation of either. Considering use of the lock 34, the lock is depressed axially inwardly against the urging of the spring 70 as shown in FIG. 9 which slides the torque blade 68 a short distance through the crank hub 50 so as to move the thumbturn 36 axially outwardly. This axial movement of the thumbturn 36 moves it axially against the urging of the coil spring 100, but more important, moves it axially relative to the coupling 94 so as to disengage the thumbturn flats 96 from the coupling flats 98 freeing the thumbturn from the coupling. Thereafter, with this temporary positioning, the lock plug 62 may be rotated by the key 64 in usual manner free of the gear means to the electrical actuation means 38 for moving the deadbolt 42 to either of its fully extended or fully retracted positions.

Figure 10:
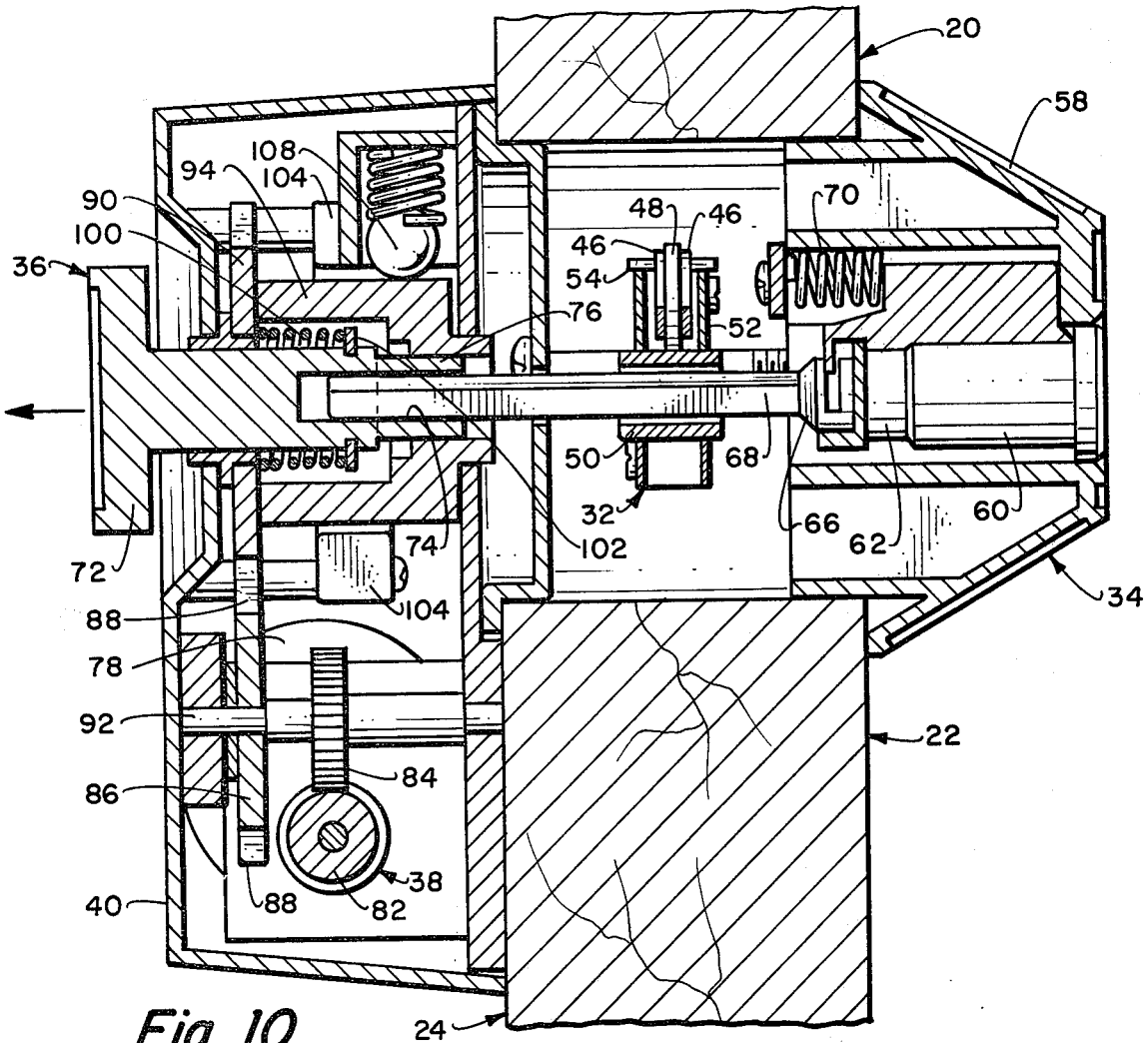
FIG. 10 is a view similar to FIG. 9, but showing the bolt ready to be manually actuated and moved from the position of FIG. 7 by the interior door side manual operator under the emergency power failure conditions.

This same manual actuation can also be accomplished by the thumbturn 36 by temporary manipulation thereof as shown in FIG. 10. The thumbturn 36 at the door interior side 24 is merely pulled a slight distance axially outwardly as shown, which moves the thumbturn axially relative to the torque blade 68 since they are only axially slideably engaged and even though the two remain rotatably engaged. This again disengages the thumbturn 36 from the driven gear 90 by axial disengagement of the flats 96 on the thumbturn from the flats 98 on the coupling so as to free the thumbturn and torque blade from restriction by the gear means of the electrical actuation means 38. Thereafter, it is only necessary to turn the thumbturn 36 in the appropriate direction to move the deadbolt 42 to either of its fully extended or fully retracted positions, neither the gear means being required to move due to the described disconnection therefrom nor the lock plug 62 due to the lost motion connection 66.

According to the principals of the present invention, therefore, a unique alternate manually and electrically actuated bolt is provided which includes two basic novel concepts, either or both of which may be incorporated. According to the one concept, when the deadbolt 42 is in either of its fully extended or fully retracted positions, at least the major portion of the electrical actuation means 38 is disconnected from the deadbolt 32 so that the deadbolt may be moved to either full position by either manual or electrical actuation and one will not interfere with the use of the other. According to the second concept, if the deadbolt 42 is being actuated by the electrical actuation means 38, is intermediate its extended and retracted positions and electrical power failure occurs, the deadbolt can still be moved manually to either of its fully extended or retracted positions by a slight temporary manipulation of the manual actuation means, that is, either the lock 34 or the thumbturn 36. The slight manipulation of either of the lock 34 or the thumbturn 36 causes temporary disconnection of the electrical actuation means 38 from the deadbolt 42 and during this temporary disconnection, the deadbolt may be moved into either full position by the usual rotation of either the lock or thumbturn. The optimum assembly includes both of the novel concepts as illustrated in the preferred embodiment shown and described.

Although the principals of the present invention have been herein illustrated in a particular embodiment of alternate manually and electrically actuated bolt, it is not intended thereby to limit principals of the present invention solely to the particular embodiment illustrated. Specifically, the alternate manually and electrically actuated bolt principals of the present invention should be broadly construed as applicable to various forms of manually and electrically actuated bolts and should not be limited in scope beyond the specific limitations and the patent equivalents thereof set forth in the appended claims.

We claim:

1. In an alternate manually and electrically actuated bolt of the type having a bolt movable between extended and retracted positions, manual operator means operably connected to said bolt for moving said bolt between said extended and retracted positions upon manual actuation thereof, an electric motor, and gear means operably connected to each of said electric motor and said bolt for moving said bolt between said extended and retracted positions upon electrical actuation of said motor; the improvements including: said gear means comprising an oppositely rotatable driven gear operably connected to said bolt for moving said bolt between said extended and retracted positions upon opposite rotatable movement of said driven gear, a driving gear segment operably connected oppositely movable by said electric motor, said driving gear segment being constructed and arranged relative to said driven gear engaging said driven gear moving said bolt between said extended and retracted positions and totally disengaging said driven gear upon said bolt moving into either of said extended and retracted positions; whereby, said bolt may be moved from either of its extended and retracted positions to the other of its extended and retracted positions by said manual operator means without movement of said driving gear segment and said electric motor.

2. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear.

3. In an alternate manually and electrically actuated bolt as defined in claim 1 in which said manual operator means includes a lock having a rotatable lock plug operably connected to said bolt for moving said bolt between said extended and retracted positions upon rotation of said lock plug.

4. In an alternate manually and electrically actuated bolt as defined in claim 1 in which said manual operator means includes first and second manual operators each operably connected to said bolt, said first manual operator being a lock having a rotatable lock plug and said second manual operator being rotatable, said bolt being moved between its extended and retracted positions upon rotation of either of said first manual operator lock plug and said second manual operator.

5. In an alternate manually and electrically actuated bolt as defined in claim 1 in which said driven gear of said gear means telescopes a portion of said manual operator means and is operably connected to bolt moving means of said bolt through said manual operator means, said portion of said manual operator means extending transversely and being rotatable by said driven gear to rotate said bolt moving means and move said bolt longitudinally between its extended and retracted positions.

6. In an alternate manually and electrically actuated bolt as defined in claim 1 in which said driving gear segment is one of at least two circumferentially spaced driving gear segments operably connected oppositely movable by said electric motor, said driving gear segments being constructed and arranged relative to said driven gear for either of said driving gear segments to engage said driven gear to move said bolt between said extended and retracted positions, both of said driving gear segments totally disengaging said driven gear upon said bolt moving into either of said extended and retracted positions.

7. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear; and in which said driving gear segment is one of at least two circumferentially spaced driving gear segments operably connected oppositely movable by said electric motor, said driving gear segments being constructed and arranged relative to said driven gear for either of said driving gear segments to engage said driven gear to move said bolt between said extended and retracted positions, both of said driving gear segments totally disengaging said driven gear upon said bolt moving into either of said extended and retracted positions.

8. In an alternate manually and electrically actuated bolt as defined in claim 1 in which said manual operator means includes a lock having a rotatable lock plug operably connected to said bolt for moving said bolt between said extended and retracted positions upon rotation of said lock plug; and in which said driving gear segment is one of at least two circumferentially spaced driving gear segments operably connected oppositely movable by said electric motor, said driving gear segments being constructed and arranged relative to said driven gear for either of said driving gear segments to engage said driven gear to move said bolt between said extended and retracted positions, both of said driving gear segments totally disengaging said driven gear upon said bolt moving into either of said extended and retracted positions.

9. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear; in which said manual operator means includes a lock having a rotatable lock plug operably connected to said bolt for moving said bolt between said extended and retracted positions upon rotation of said lock plug; and in which said driving gear segment is one of at least two circumferentially spaced driving gear segments operably connected oppositely movable by said electric motor, said driving gear segments being constructed and arranged relative to said driven gear for either of said driving gear segments to engage said driven gear to move said bolt between said extended and retracted positions, both of said driving gear segments totally disengaging said driven gear upon said bolt moving into either of said extended and retracted positions.

10. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear; in which said driven gear of said gear means telescopes a portion of said manual operator means and is operably connected to bolt moving means of said bolt through said manual operator means, said portion of said manual operator means extending transversely and being rotatable by said driven gear to rotate said bolt moving means and move said bolt longitudinally between its extended and retracted positions; and in which said driving gear segment is one of at least two circumferentially spaced driving gear segments operably connected oppositely movable by said electric motor, said driving gear segments being constructed and arranged relative to said driven gear for either of said driving gear segments to engage said driven gear to move said bolt between said extended and retracted positions, both of said driving gear segments totally disengaging said driven gear upon said bolt moving into either of said extended and retracted positions.

11. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear; in which said manual operator means includes a lock having a rotatable lock plug operably connected to said bolt for moving said bolt between said extended and retracted positions upon rotation of said lock plug; in which said driven gear of said gear means telescopes a portion of said manual operator means and is operably connected to bolt moving means of said bolt through said manual operator means, said portion of said manual operator means extending transversely and being rotatable by said driven gear to rotate said bolt moving means and move said bolt longitudinally between its extended and retracted positions; and in which said driving gear segment is one of at least two circumferentially spaced driving gear segments operably connected oppositely movable by said electric motor, said driving gear segments being constructed and arranged relative to said driven gear for either of said driving gear segments to engage said driven gear to move said bolt between said extended and retracted positions, both of said driving gear segments totally disengaging said driven gear upon said bolt moving into either of said extended and retracted positions.

12. In an alternate manually and electrically actuated bolt as defined in claim 1 in which selectively operable manually actuated gear disengagement means is operably associated with said gear means for temporarily disconnecting certain of said gear means from said bolt upon said electric motor stopping during said motor moving said bolt intermediate said extended and retracted positions while permitting movement of said bolt by said manual operator means upon manual actuation thereof.

13. In an alternate manually and electrically actuated bolt as defined in claim 1 in which said driven gear of said gear means is operably connected to said bolt through parts of said manual operator means; and in which selectively operable manually actuated gear disengagement means is operably associated with said gear means for temporarily disconnecting certain of said gear means from said bolt upon said electric motor stopping during said motor moving said bolt intermediate said extended and retracted positions while permitting movement of said bolt by said manual operator means upon manual actuation thereof.

14. In an alternate manually and electrically actuated bolt as defined in claim 1 in which said driven gear of said gear means is operably connected to said bolt through parts of said manual operator means; and in which selectively operable manually actuated gear disengagement means is operably associated with said driven gear of said gear means for temporarily disconnecting said driven gear of said gear means from said manual operator means parts upon said electric motor stopping during said motor moving said bolt intermediate said extended and retracted positions while permitting movement of said bolt by said manual operator means upon manual actuation thereof.

15. In an alternate manually and electrically actuated bolt as defined in claim 1 in which said driven gear of said gear means is operably connected to said bolt through parts of said manual operator means; and in which selectively operable manually actuated gear disengagement means is operably associated with said driven gear of said gear means for temporarily disconnecting said driven gear from said manual operator means parts during selected axial movement of said manual operator means upon said electric motor stopping during said motor moving said bolt intermediate said extended and retracted positions while permitting movement of said bolt by said manual operator means upon manual actuation thereof.

16. In an alternate manually and electrically actuated bolt as defined in claim 1 in which said driven gear of said gear means is operably connected to said bolt through parts of said manual operator means; and in which selectively operable manually actuated gear disengagement means is operably associated with said gear means for temporarily disconnecting certain of said gear means from said bolt during temporary axial movement of said manual operator means upon said electric motor stopping during said motor moving said bolt intermediate said extended and retracted positions while permitting movement of said bolt by said manual operator means upon manual actuation thereof.

17. In an alternate manually and electrically actuated bolt as defined in claim 1 in which said manual operator means includes a lock having a rotatable lock plug operably connected to said bolt moving said bolt between said extended and retracted positions upon rotation of said lock plug; in which said driven gear of said gear means is operably connected to said bolt through parts of said manual operator means; and in which selectively operable manually actuated gear disengagement means is operably associated with said gear means for temporarily disconnecting certain of said gear means from said bolt during temporary axial movement of said lock plug upon said electric motor stopping during said motor moving said bolt intermediate said extended and retracted positions while permitting movement of said bolt by said lock plug upon manual rotation thereof.

18. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear; and in which selectively operable manually actuated gear disengagement means is operably associated with said gear means for temporarily disconnecting certain of said gear means from said bolt upon said electric motor stopping during said motor moving said bolt intermediate said extended and retracted positions while permitting movement of said bolt by said manual operator means upon manual actuation thereof.

19. In an alternate manually and electrically actuated bolt as defined in claim 1 in which said driven gear of said gear means telescopes a portion of said manual operator means and is operably connected to bolt moving means of said bolt through said manual operator means, said portion of said manual operator means extending transversely and being rotatable by said driven gear to rotate said bolt moving means and move said bolt longitudinally between its extended and retracted positions; and in which selectively operable manually actuated gear disengagement means is operably associated with said gear means for temporarily disconnecting certain of said gear means from said bolt upon said electric motor stopping during said motor moving said bolt intermediate said extended and retracted positions while permitting movement of said bolt by said manual operator means upon manual actuation thereof.

20. In an alternate manually and electrically actuated bolt as defined in claim 1 in which positive positioning means is operably connected to said bolt for automatic actuation as said bolt approaches either of its extended and retracted positions to urge said bolt fully into its extended and retracted positions insuring full positioning of said bolt in its extended and retracted positions during and following said driving gear segment disengagement from said driven gear; in which said driven gear of said gear means telescopes a portion of said manual operator means and is operably connected to bolt moving means of said bolt through said manual operator means, said portion of said manual operator means extending transversely and being rotatable by said driven gear to rotate said bolt moving means and move said bolt longitudinally between its extended and retracted positions; and in which selectively operable manually actuated gear disengagement means is operably associated with said gear means for temporarily disconnecting certain of said gear means from said bolt upon said electric motor stopping during said motor moving said bolt intermediate said extended and retracted positions while permitting movement of said bolt by said manual operator means upon manual actuation thereof.

21. In an alternate manually and electrically actuated bolt of the type having a bolt movable between extended and retracted positions, manual operator means operably connected to said bolt for moving said bolt between said extended and retracted positions upon manual actuation thereof, an electric motor, gear means operably connected to each of said electric motor and said bolt for moving said bolt between said extended and retracted positions upon electrical actuation of said motor; the improvements including: said gear means normally being and remaining engaged between said bolt and said electric motor upon stopping of said electric motor intermediate movement thereby of said bolt between said extended and retracted positions; selectively operable manually actuated gear disengagement means operably associated with said gear means for temporarily disconnecting certain of said gear means from said bolt upon said electric motor stopping during said motor intermediate movement while permitting movement of said bolt by said manual operator means upon manual actuation thereof.

22. In an alternate manually and electrically actuated bolt as defined in claim 21 in which said gear means is operably connected to said bolt through said manual operator means.

23. In an alternate manually and electrically actuated bolt as defined in claim 21 in which said gear means includes a driven gear operably connected to parts of said manual operator means moving said bolt through said manual operator means between said extended and retracted positions; and in which said gear disengagement means temporarily disconnects certain of said gear means from said bolt during temporary selected movement of said manual operator means.

24. In an alternate manually and electrically actuated bolt as defined in claim 21 in which said gear means includes a driven gear normally connected to said bolt through said manual operator means by engagement with parts of said manual operator means; and in which said gear disengagement means is operably associated with said driven gear of said gear means for temporarily disconnecting said driven gear from said manual operator means to thereby disconnect said driven gear from said bolt.

25. In an alternate manually and electrically actuated bolt as defined in claim 21 in which said manual operator means is selectively temporarily axially movable and is operably connected to said bolt for moving said bolt between said extended and retracted positions by rotation of said manual operator means in any of its axial positions; and in which said gear disengagement means is operably connected to said manual operator means for temporarily disconnecting certain of said gear means from said bolt upon said manual operator means being temporarily moved axially.

26. In an alternate manually and electrically actuated bolt as defined in claim 25 in which said manual operator means includes a lock having a rotatable lock plug operably connected to said bolt for moving said bolt between said extended and retracted positions upon rotation of said lock plug, said lock plug also being temporarily axially movable and being operably connected to said gear disengagement means for temporarily disconnecting certain of said gear means from said bolt during said selected axial movement of said lock plug.

27. In an alternate manually and electrically actuated bolt as defined in claim 25 in which said manual operator means includes first and second manual operators, said first manual operator comprising a lock with a rotatable and temporarily axially movable lock plug, said second manual operator comprising rotatable and temporarily axially movable actuating means, each of said lock plug of said first operator and said actuating means of said second operator being operably connected to said bolt to move said bolt between its extended and retracted positions upon rotation thereof and operably connected to said gear disengagement means for temporarily disconnecting certain of said gear means from said bolt upon said temporary axial movement thereof.

28. In an alternate manually and electrically actuated bolt as defined in claim 21 in which said gear means includes a driven gear normally engaged with parts of said manual operator means for moving said bolt either manually or upon rotation of said manual operator means parts by said driven gear; and in which said gear disengagement means is operably associated with said driven gear and said manual operator means for temporarily disconnecting said driven gear and said manual operator means parts by relative axial movement therebetween.

29. In an alternate manually and electrically actuated bolt as defined in claim 28 in which said manual operator means includes a lock with a rotatable and temporarily axially movable lock plug, rotation of said lock plug in any axial position thereof moving said bolt between its extended and retracted positions, said lock plug being operably connected to said manual operator means parts for axially moving said parts relative to said driven gear to temporarily disconnect said parts and said driven gear upon said temporary axial movement of said lock plug.

30. In an alternate manually and electrically actuated bolt as defined in claim 28 in which said manual operator means includes a first manual operator and a second manual operator, said first manual operator comprising a lock with a rotatable and temporarily axially movable lock plug, said lock plug being rotatable in any axial position for moving said bolt between its extended and retracted positions, said second manual operator comprising rotatable and temporarily axially movable actuating means, said actuating means being rotatable in any axial position for moving said bolt between its extended and retracted positions, both of said lock plug and actuating means being operably connected to said manual operator means parts for temporarily axially moving said parts relative to said driven gear disconnecting said parts from said driven gear upon said temporary axial movement of said lock plug or actuating means.

31. In an alternate manually and electrically actuated bolt as defined in claim 21 in which said manual operator means is rotatable about a transverse axis rotating a torque blade thereof, said torque blade being connected to and rotating bolt moving means, said bolt moving means being operably connected to said bolt for moving said bolt between its extended and retracted positions upon rotation of said bolt moving means by said torque blade, said manual operator means also being temporarily axially movable along said transverse axis while remaining rotatable in any axial position thereof; in which said gear means includes a driven gear; and in which said gear disengagement means is operably associated with said driven gear and said manual operator means for normally connecting said driven gear and said manual operator means to rotate said manual operator means and move said bolt between its extended and retracted positions, said gear disengagement means temporarily interrupting said connection between said driven gear and said manual operator means upon said temporary axial movement of said manual operator means along said transverse axis.

32. In an alternate manually and electrically actuated bolt as defined in claim 31 in which said driven gear of said gear means is telescoped with said manual operator means about said transverse axis.

33. In an alternate manually and electrically actuated bolt as defined in claim 31 in which said driven gear of said gear means is telescoped with said manual operator means about said transverse axis; and in which said manual operator means includes a lock with a rotatable and temporarily axially movable lock plug operably connected to said torque blade, said lock plug axially moving said manual operator means by axial depression of said lock plug.

34. In an alternate manually and electrically actuated bolt as defined in claim 31 in which said gear disengagement means includes resilient means normally urging said manual operator means into its normal axial position engaging said manual operator means with said driven gear.

35. In an alternate manually and electrically actuated bolt as defined in claim 31 in which said driven gear of said gear means is telescoped with said manual operator means about said transverse axis; in which said manual operator means includes a lock with a rotatable and temporarily axially movable lock plug operably connected to said torque blade, said lock plug axially moving said manual operator means by axial depression of said lock plug; and in which said gear disengagement means includes resilient means normally urging said manual operator means into its normal axial position engaging said manual operator means with said driven gear.

36. In an alternate manually and electrically acuated bolt as defined in claim 31 in which said driven gear of said gear means is telescoped with said manual operator means about said transverse axis; in which said manual operator means includes first and second manual operators, said first manual operator comprising a lock with a rotatable and temporarily axially movable lock plug operably connected to said torque blade, said lock plug axially moving said manual operator means by axial depression of said lock plug, said second manual operator having parts rotatable and temporarily axially movable, said second manual operator parts being operably connected to said torque blade and axially moving said manual operator means during axial movement thereof; and in which said gear disengagement means includes resilient means normally urging said manual operator means into its normal axial position engaging said manual operator means with said driven gear.

* * * * *